US007647858B2

(12) United States Patent
Rother et al.

(10) Patent No.: US 7,647,858 B2
(45) Date of Patent: Jan. 19, 2010

(54) DIFFERENTIAL PISTON

(75) Inventors: Sylva Rother, Kressbronn (DE); Michael Obergasser, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 220 days.

(21) Appl. No.: 11/780,677

(22) Filed: Jul. 20, 2007

(65) Prior Publication Data

US 2008/0072590 A1 Mar. 27, 2008

(30) Foreign Application Priority Data

Jul. 22, 2006 (DE) ..... 10 2006 033 984

(51) Int. Cl.
*F15B 15/17* (2006.01)

(52) U.S. Cl. ..... 91/415; 91/417 R

(58) Field of Classification Search ..... 91/415, 91/416, 417 R
See application file for complete search history.

(56) References Cited

U.S. PATENT DOCUMENTS 2,575,982 A * 11/1951 Stevens ..... 91/415
3,327,545 A 6/1967 Petty
3,378,111 A 4/1968 Greer et al.
6,595,339 B1 7/2003 Bauknecht et al.

FOREIGN PATENT DOCUMENTS

| | | |
|---|---|---|
| DE | 1 217 800 | 5/1966 |
| DE | 1 500 456 | 7/1969 |
| DE | 1 575 863 | 2/1970 |
| DE | 2 310 383 | 9/1974 |
| DE | 199 32 614 A1 | 1/2001 |
| GB | 1 425 276 | 2/1976 |

* cited by examiner

*Primary Examiner*—Michael Leslie
(74) *Attorney, Agent, or Firm*—Davis & Bujold, P.L.L.C.

(57) ABSTRACT

A differential piston (1), designed as an annular piston, having pressure chambers (8, 9) with at least one of the pressure chambers (8, 9) being pressurized from radially inside the differential piston (1), via a hollow shaft (29) or another radially inner element (16), such as, part of a (cylinder) housing element (20) and a radial pressure medium-guiding channel (13) arranged directly within the differential piston (1), such that only a single additional sealing element (18) is required.

9 Claims, 2 Drawing Sheets

DIFFERENTIAL PISTON

This application claims priority from German Application Serial No. 10 2006 033 984.3 filed Jul. 22, 2006.

FIELD OF THE INVENTION

The invention relates to a device for supplying a differential piston with working fluid.

BACKGROUND OF THE INVENTION

Differential pistons are pistons in piston-cylinder arrangements with pressure being applied to opposite sides of the piston. They are used either to displace the differential piston in two opposite directions as a result of the fluid action and/or they are used to bring the piston in a predetermined position with a lot of sensitivity, achieve a desired speed profile of the piston and/or more precisely adjust the resulting force applied by the piston.

In principle, a differential piston has at least two pressure surfaces, each of which is associated with a pressure chamber arranged such that the alternate action of a working fluid upon the pressure surfaces brings about a force on the piston in alternating, opposite directions. The resulting piston force is achieved as the product of the effective pressure surface and the pressure of the working fluid, while neglecting marginal variables. When simultaneously applying a force on effective pressure surfaces with opposite effective directions, the resulting piston force emerges as a differential or proper-sign addition of the partial piston forces.

If the piston, following a deflection by applying pressure on a first pressure chamber, is not returned to the starting position by an external force, that is applied by way of a mechanical spring, or if the restoring force is supposed to be adjustable, the first pressure chamber can be depressurized or the pressure thereof can be reduced and the second pressure chamber of the piston can be returned to the starting position using a defined force by way of metered pressure application.

If the pressure surfaces, arranged on opposite sides of the piston and effective for pressure application by way of a working fluid, have substantially the same size, a given pressure application on one of the two pressure surfaces of the piston results in a force, which is at least substantially equivalent to, but has an opposite effective direction to a force that would be obtained under otherwise equivalent conditions if pressure were applied to the respective other pressure surface. Such a differential piston, therefore, can be actuated almost equally in both directions through the opening and associated depressurization of one pressure chamber and the application pressure to the respective other pressure chamber.

Furthermore, differential pistons are used in order to apply relatively high resulting forces on the piston or to achieve high displacement speeds on the one hand and, if necessary, to perform even a sensitive adjustment of the resulting piston force, the piston speed and/or the piston position on the other hand. For this, in the case of large resulting piston forces at a given maximum pressure of the working fluid, a relatively large resulting piston surface is required, while in the case of small resulting piston forces, the sensitive adjustment of the piston speed or the piston position, a comparatively small resulting piston surface is advantageous. The resulting piston surface on the differential piston is obtained from the difference of the piston surfaces provided on opposite sides of the piston. Of course, it is also possible that a plurality of partial piston surfaces act additively on at least one side of the piston and/or that the effective piston surfaces change across the displacement range of the piston as a result of an appropriate geometric design.

The design-specific advantages of the differential piston, explained above, offer the possibility of bringing about high piston forces and fast piston movement as well as enabling slow piston movements, precise piston positioning and low resulting piston forces and reversing the effective direction of the piston, which means that mechanical return springs can be foregone and the restoring force can be adjusted in a simple and precise manner.

Compared to alternative solutions, further advantages are the lower number of functionally required parts, the relatively simple and space-saving design, the resulting generally lower manufacturing costs and a comparatively low total weight. As a result, differential pistons, particularly in the area of transmission technology, and in this area particularly among automatic transmissions and, in particular, among automatic transmission for motor vehicles, offer special advantages. The use of differential pistons in these areas is already known from German patent No. DE 199 32 614 A1 by the Applicant.

However, particularly in this area, the large variety of framework conditions and particularly the need for integrating a large number of components and functions in a small installation space at times produces space conditions, which previously prevented the use of differential pistons or at least made it more difficult.

In particular, a conventional design of the differential pistons in which both pressure chambers are supplied by separate fluid lines, were previously difficult or even impossible if (due to the available installation space) at least one fluid line had to be or was preferably arranged on one side of the piston, while the pressure chamber to be acted upon by this side was arranged on the other side of the piston and bypassing the piston by way of a closed loop, was not possible or desirable.

It is possible in the majority of cases to guide the end of a fluid line from a side facing away from the pressure chamber through a corresponding line bypassing the piston to a side facing the pressure chamber and connect the pressure chamber in this way to the fluid line. This, however, frequently requires considerably long lines and geometrically complicated line routing which, on one hand, causes considerable manufacturing expenses and, therefore, high costs and, on the other hand, due to the generally high specific resistance, can result in an undesirable drop in pressure and in oscillation problems, particularly in pneumatically operated systems.

Particularly in the case of differential pistons with a substantially annular shape and with pistons that are arranged on an axle or shaft, as is frequently the case in transmissions, at least one of the pressure chambers can advantageously be supplied via axial and radial fluid channels configured within the axle or shaft. However, if short line lengths are desired and existing shaft or axle diameters, according to the state of the art, are used, this is frequently only possible for a maximum of one pressure chamber of the differential piston. In addition, the access to the other pressure chamber is generally blocked by the piston itself and, therefore, can not be supplied by a simple axial bore. In this case, it was necessary until now to bypass the differential piston with more or less clearance if a supply of pressure medium from the outside was not desired.

For such a closed loop, an axial bore of an axle or shaft mounted inside the differential piston can be routed to the outside through a radial bore that is provided in a suitable location and can be connected in a sealed manner to a section of another part, for example an encompassing housing, the working fluid being directed radially outward through the bore to supply the pressure chamber with working fluid from the radially exterior side or laterally. This, however, is typically associated with the aforementioned disadvantages.

Against this background, the invention is based upon the objective of presenting a differential piston in which the supply of a pressure chamber with a working fluid can be guaranteed without complex bypass lines even if the pressure chamber to be subjected to pressure and the respective working fluid supply are arranged on opposite sides of the piston or if the working fluid supply is arranged radially inside the annular piston and a pressure chamber axially facing the piston is supposed to be supplied with pressure.

SUMMARY OF THE INVENTION

The invention is based on the knowledge that the above problems can be avoided if the pressure medium supply to a pressure chamber passes through a channel situated in the differential piston.

Accordingly, the invention proceeds from a differential piston having a first section extending substantially perpendicular to the direction of motion of the differential piston, a second section extending substantially in the direction of motion of the differential piston and a first effective piston surface on a first side and a second effective piston surface on a second side of the first section of the differential piston, with the first effective piston surface being associated with a first pressure chamber and the second effective piston surface is associated with a second pressure chamber, a pressurized working fluid, particularly a hydraulic fluid or compressed air, being directed in the chambers, via at least one fluid channel, and at least the first or the second pressure chamber is delimited by at least part of the second section extending substantially in the direction of motion.

This part of the second, axial section of the differential piston is arranged between the working fluid supply and the pressure chamber to be supplied and, according to the state of the art, requires a more or less complex bypass design.

To solve the task at hand, it is provided that the differential piston has a pressure medium channel through which at least one fluid channel can communicate with at least one of the pressure chambers.

This surprisingly simple solution can avoid a majority of the aforementioned problems of the state of the art and as a result, in particular, shorter passages as well as lower specific resistances can be achieved. Due to the lower manufacturing costs, the aforementioned pressure medium-guiding channel for guidance of the pressurized working fluid is preferably closed and provided entirely inside the differential piston. In individual cases, however, it may also be expedient to provide only a recess instead of a bore hole, such as in the form of a milled groove on the surface of the piston, which together with a corresponding surface of the housing encompassing the differential piston then forms the pressure medium-guiding channel.

It is frequently advantageous if the pressure medium-guiding channel is arranged at least substantially inside the second section of the differential piston extending in the direction of motion of the differential piston, such that relatively short passages within the differential piston and, in most cases, straight line routing can be implemented.

If, however, the pressure medium-guiding channel is arranged at least substantially inside the radial first section of the differential piston, the potential piston stroke in an otherwise equivalent design can optionally be increased because providing working fluid to the second pressure chamber is then not limited by a seal that seals the second axial section of the differential piston. Furthermore, such a design also enables supplying a pressurized fluid to the first pressure chamber.

The invention is particularly significant if the differential piston is configured as an annular piston, extending radially with regard to the direction of motion of the differential piston because, in this case, on one hand, often a working fluid supply through the central cavity in the interior of the piston is expedient and, on the other hand, a bypass line is typically very complex and associated with long line paths and high specific resistances.

The pressure supply channel has an aperture in a radially inner wall of the annular piston that allows working fluid to enter and/or exit. In the majority of cases, the radially inner wall is circular, when viewed from above in the direction of motion of the differential piston, however it may also have any other arbitrary contour, if necessary. In any case, such a design allows a substantially direct line routing.

If a further element is arranged radially inside of the radially inner wall such that at least one fluid channel is incorporated to provide for a pressurized fluid connection to the pressure-guiding channel, this has the advantage that, if necessary, a plurality of separate bores or pressure medium-guiding channels can also be provided and both pressure chambers can be supplied separately with working fluid.

In this connection, it is particularly advantageous if the further element is a shaft or axle, because relatively common designs of shafts carrying or supporting the differential piston can be adapted without difficulty and, in addition, a hollow shaft can be used for supplying the working fluid in the known manner. Of course, it is also possible to use a combination of a plurality of nested hollow shafts or hollow axles in place of the hollow shaft or hollow axle.

In order to ensure a pressurized and pressure-tight fluid connection between the fluid channel, which is provided in the hollow shaft, and the differential piston, first and second sealing elements are advantageously provided in the displacement direction of the differential piston on either side of the fluid connection. The exact configuration of these elements depends on the operating conditions of each individual case and particularly on the working medium, as well as the need for tightness. Here, basically any arbitrarily known solutions for a radial pressure-tight connection of an inner bore of a shaft or hollow shaft to the outside of a second hollow shaft receiving the shaft or hollow shaft can be adapted.

If additionally the further element, which is to say a hollow shaft, is connected in a rotationally fixed manner to a housing element comprising, in some areas, at least one of the pressure chambers of the differential piston, based on the substantially excluded relative rotation between the differential piston and the further element, simple seals such as O-rings can be used, which are not designed for a relative rotational movement between the further element and the radially inner wall of the annular piston. In addition, in this way the second pressure chamber is particularly easy to control by way of a second fluid channel inside the second element, where only a connection is required to the corresponding pressure chamber by way of a radial borehole.

BRIEF DESCRIPTION OF THE DRAWING

The invention will now be described, by way of example, with reference to the accompanying drawing in which.

DETAILED DESCRIPTION OF THE INVENTION

Figure 1:
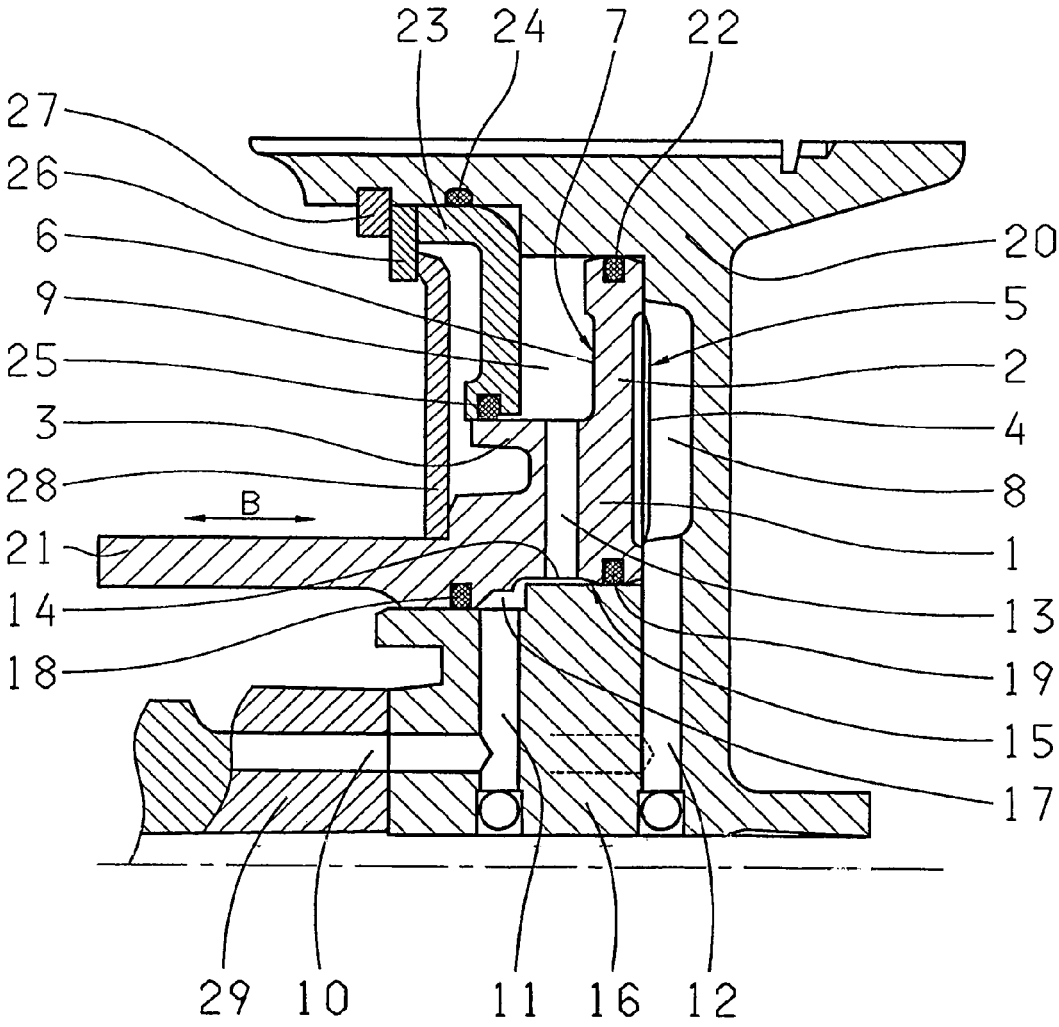
FIG. 1 shows an upper half of a rotationally symmetrical differential piston of the present.
Figure 2:
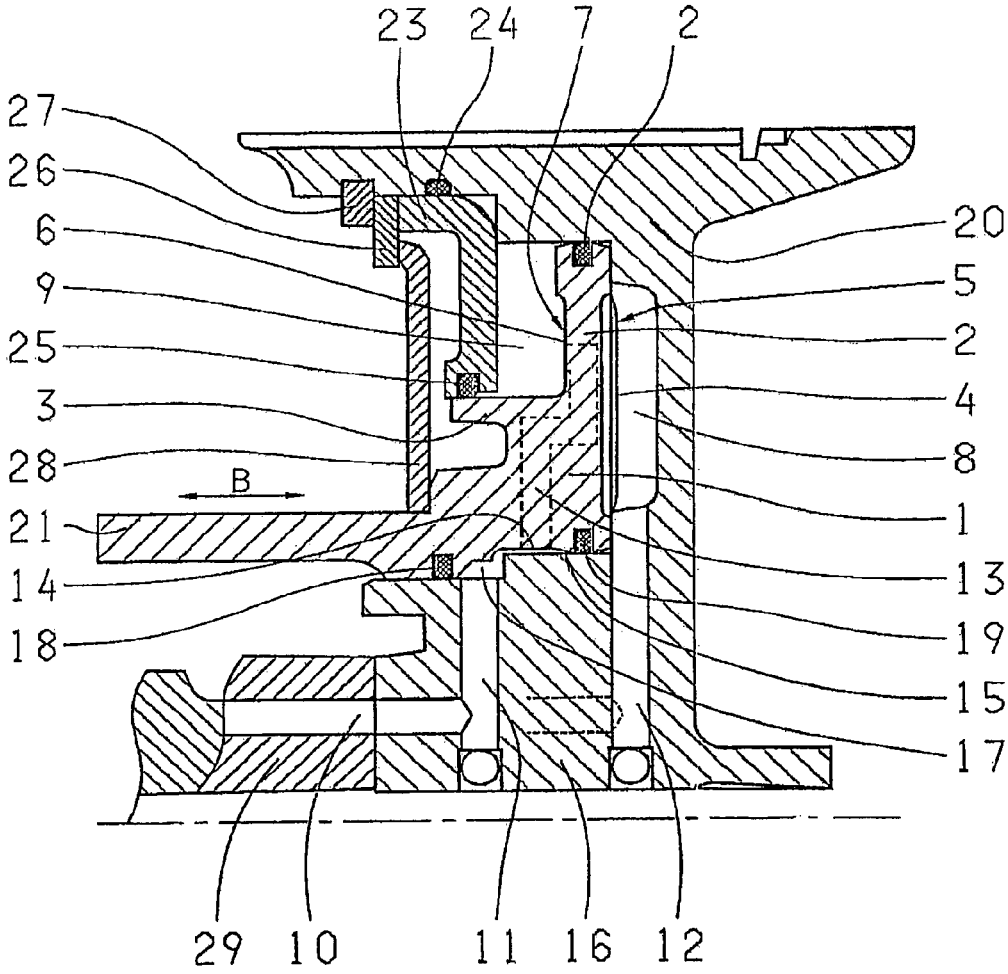
FIG. 2 is a diagrammatic view, similar to FIG. 1. showing the pressure medium-guiding channel substantially inside the first section (2) of the differential piston (1).

This Figure shows the upper half of a rotationally symmetrical differential piston 1, which comprises a substantially radial first section 2, relative to a direction B of displacement of the differential piston 1, and a second section 3 extending substantially in the direction B of displacement of the differential piston 1. The first section 2 on a first (right) side 5 thereof has a first effective piston surface 4 which, in conjunction with the sealing elements 19 and 22, as well as a section of a housing element 20, functionally forms a first pressure chamber 8 of the arrangement.

The pressure chamber 8 is supplied with pressure fluid via a third fluid channel 12 in the housing element 20. Besides housing the differential piston 1, the housing element 20, at the same time, can also serve as a disk carrier of a multi-disk clutch or multi-disk brake and for this purpose, as is indicated in the Figure, may have axial teeth on the radially outer end.

On a second (left) side 7 of the radial first section 2 of the differential piston 1 a second effective, in this case, smaller piston surface 6 is provided which, together with a sleeve element 23, associated inner and outer sleeve seals 24 and 25, the axial second section 3 of the differential piston 1, as well as an axial section of the housing element 20, defines a second pressure chamber 9. The sleeve element 23 is attached to the housing element 20 by a washer 26 and a retaining ring 27. The washer 26, at the same time, supports a disk spring 28, which axially prestresses the differential piston 1 in the direction of the first pressure chamber 8.

The differential piston 1, furthermore, has a sleeve-like piston extension 21, which can apply an actuating force on a multi-disk clutch or multi-disk brake, which is not shown.

According to the invention, inside the differential piston 1, in this case inside the axial second section 3 of the differential piston 1, a pressure medium-guiding channel 13 is provided which, in this example, has the shape of a radial bore. This radial bore 13 ends at the radially outer end thereof in the second pressure chamber 9 and with the radially inner end thereof in an aperture 14 of a radially inner wall 15 of the differential piston 1 which, in this example, is configured as an annular piston. This radial bore 13 is connected to a second radial fluid channel 11, via a pressurized fluid connection 17, where working fluid leakage is prevented by first and second sealing elements 18 and 19. Here, it should be pointed out, in particular, that at least the second sealing element 19 is advantageously required for sealing the first pressure chamber 8 in relation to the housing element 20 and/or a further element 16.

In the illustrated example, the housing element 20 and the further element 16 transition into a one-piece configuration, where the fluid supply to the second pressure chamber 9 is guaranteed by a hollow shaft 29 with a seal (not shown) for guiding the fluid channel 10 into a further element 16.

In the scope of the present invention, it is arbitrary whether the further element 16 is a geometrically separate element, such as in the example shown, a component of a housing element 20 or a component of a hollow shaft 29 or another part, for example a passage.

It is rather essential to the invention that the second pressure chamber 9 can be supplied with working fluid, directly and radially by the differential piston 1, with the help of the pressure-guiding channel 13 where, in an expedient embodiment as shown here, aside from the pressure-guiding channel 13, only one further sealing element 18 is to be provided.

REFERENCE NUMERALS

1 differential piston, annular piston
2 first section of the differential piston 1
3 second section of the differential piston 1
4 first piston surface of the differential piston 1
5 first side of the first section of the differential piston 1
6 second piston surface of the differential piston 1
7 second side of the first section of the differential piston 1
8 first pressure chamber
9 second pressure chamber
10 first fluid channel
11 second fluid channel
12 third fluid channel
13 pressure medium-guiding channel, radial bore
14 aperture
15 radially inner wall of the annular piston
16 further element
17 pressurized fluid connection
18 first sealing element
19 second sealing element
20 housing element
21 sleeve-like piston extension
22 outer sealing element
23 sleeve element
24 sleeve seal, outer
25 sleeve seal, inner
26 washer
27 retaining ring
28 disk spring
29 hollow shaft
B direction of motion of the differential piston

The invention claimed is:

1. A differential piston (1) having a first section (2), extending substantially perpendicular to a direction (B) of motion of the differential piston (1), and a second section (3), extending substantially in the direction (B) of motion of the differential piston (1), the second section (3) of the differential piston (1) being radially located within the first section (2) of the differential piston (1), and the first section (2) of the differential piston (1) having a first effective piston surface (4), on a first side (5) thereof, and a second effective piston surface (6) on a second side thereof, the first effective piston surface (4) being associated with a first pressure chamber (8) and the second effective piston surface (6) being associated with a second pressure chamber (9), a pressurized working fluid being supplied to the first and the second pressure chambers, via at least one fluid channel (10, 11, 12), at least one of the first pressure chamber (8) and the second pressure chamber (9) being delimited by at least some areas of the second section (3) extending substantially in the direction (B) of displacement, and the differential piston (1) having a pressure medium-guiding channel (13), in communication with the at least one fluid channel (10, 11, 12) and extending to at least one of the pressure chambers (8, 9); and the pressure medium-guiding channel (13) is arranged at least partially inside the first section (2) of the differential piston (1) which extends substantially perpendicular to the direction (B) of displacement of the differential piston (1).

2. The differential piston according to claim 1, wherein the pressure medium-guiding channel (13) is arranged substantially inside the second section (3) of the differential piston (1) which extends in the direction (B) of displacement of the differential piston (1).

3. The differential piston according to claim 1, wherein the differential piston (1) is an annular piston (1) extending radially from the direction (B) of displacement of the differential piston (1).

4. The differential piston according to claim 3, wherein the pressure medium-guiding channel (13) has, in a radially inner wall (15) of the annular piston (1), an aperture (14).

5. A differential piston (1) having a first section (2), extending substantially perpendicular to a direction (B) of motion of the differential piston (1), and a second section (3), extending substantially in the direction (B) of motion of the differential piston (1), and the first section (2) of the differential piston (1) having a first effective piston surface (4), on a first side (5) thereof, and a second effective piston surface (6) on a second side thereof, the first effective piston surface (4) being associated with a first pressure chamber (8) and the second effective piston surface (6) being associated with a second pressure chamber (9);

a pressurized working fluid being supplied to the first and the second pressure chambers, via at least one fluid channel (10, 11, 12), at least one of the first pressure chamber (8) and the second pressure chamber (9) being delimited by at least some areas of the second section (3) extending substantially in the direction (B) of displacement;

the differential piston (1) having a pressure medium-guiding channel (13), in communication with the at least one fluid channel (10, 11, 12) and extending to at least one of the pressure chambers (8, 9);

the differential piston (1) being an annular piston (1) extending radially from the direction (B) of displacement of the differential piston (1);

the pressure medium-guiding channel (13) having an aperture (14) in a radially inner wall (15) of the annular piston (1); and a further element (16) is arranged radially inside the radially inner wall (15) of the annular piston (1), the further element (16) contains the at least one fluid channel (10, 11, 12), which communicates with the pressure-guiding channel (13) via a pressurized fluid connection (17).

6. The differential piston according to claim 5, wherein the further element (16) is one of a shaft and an axle.

7. The differential piston according to claim 5, wherein the pressurized fluid connection (17) extends in the direction (B) of displacement of the differential piston (1) and is sealed, on one side, in a fluid tight manner by a first sealing element (18) and, on another side, by a second sealing element (19).

8. The differential piston according to claim 5, wherein the further element (16) is connected in a rotationally fixed manner to a housing element (20) which at least comprises partially one of the first pressure chamber (8) and the second pressure chamber (9).

9. A differential piston (1) comprising:

a first section (2) extending substantially radially with respect to a direction of motion (B) of the differential piston (1), the first section (2) having a first effective piston surface (4) on a first axial side (5) and a second effective piston surface (6) on an opposite second axial side (7);

a second section (3) extending substantially axially with respect to the direction of motion (B) of the differential piston (1), the second section (3) being radially located within the first section (2);

a first pressure chamber (8) being at least partially defined by the first effective piston surface (4);

a second pressure chamber (9) being at least partially defined by the second effective piston surface (6) and the second section (3) of the differential piston (1);

at least a first fluid channel (12) for conducting a pressurized working fluid to the first pressure chamber (8); and a pressure medium-guiding channel (13) extending, with respect to the direction of motion (B) of the differential piston (1), radially inwardly between a radially interior surface of the differential piston (1) and a radially exterior surface of the second section (3) from the second chamber (9) to a fluid connection (17) located on an interior of the differential piston (1), the fluid connection (17) communicating with at least one second fluid channel (10,11) such that a pressurized working fluid being conveyable through the at least one second fluid channel (10, 11), the fluid connection (17) and radially through the differential piston (1) to the second chamber (9).

* * * * *